US007040923B1

(12) United States Patent
Min-Chen et al.

(10) Patent No.: US 7,040,923 B1
(45) Date of Patent: May 9, 2006

(54) SUPPORTING APPARATUS

(75) Inventors: Hsu Min-Chen, Taipei Hsien (TW); Lu Chang-Kun, Chung-Ho (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 09/330,034

(22) Filed: Jun. 11, 1999

(51) Int. Cl.
*H01R 13/60* (2006.01)

(52) U.S. Cl. ..... 439/534; 439/669

(58) Field of Classification Search ..... 439/534, 439/668, 669, 686; 379/446
See application file for complete search history.

(56) References Cited

U.S. PATENT DOCUMENTS 4,325,599 A * 4/1982 Feldman ..... 439/669
5,090,921 A * 2/1992 van der Laar ..... 439/668
5,131,869 A * 7/1992 Wharton ..... 439/669
5,860,824 A * 1/1999 Fan ..... 439/534

FOREIGN PATENT DOCUMENTS

TW 335994 7/1998

* cited by examiner

*Primary Examiner*—Hien Vu
(74) *Attorney, Agent, or Firm*—Winston Hsu

(57) ABSTRACT

The invention relates to a supporting apparatus for supporting an electric device in a car. The supporting apparatus comprises a plug having a front end and a rear end over which the front end of the plug being can be plugged into and fixed in an electric socket of the car, a flexible steel tube having two ends fixed to the rear end of the plug and the electric device separately, a plurality of flexible steel wire ropes each having two ends fixed to the rear end of the plug and the electric device separately, the plurality of steel wire ropes being positioned separately at two sides of the steel tube for strengthening the steel tube, and an electric wire installed in the steel tube for electrically connecting the electric device to the plug. When a user bends or rotates the supporting apparatus, the steel tube and steel wire ropes of the supporting apparatus will be flexibly bent or rotated and the electric device will be approximately maintained at the bent or rotated position.

8 Claims, 2 Drawing Sheets

SUPPORTING APPARATUS

BACKGROUND OF THE INVENTION

1. Field of the Invention

The invention relates to a supporting apparatus, and more particularly, to a supporting apparatus for supporting an electric device in a car.

2. Description of the Prior Art

Electrical devices used in a car, such as cellular phones, LCD televisions, and electric fans, are powered by plugging into an electric cigarette lighter. Plugs can be directly plugged into some electrical devices whereas connecting devices are needed for certain other electrical devices. Electrical devices that lack a connecting device must be small but may still often seriously interfere with operation of parts of the car such as the stickshift.

The prior art connecting device is designed with an electrical cable, a single wire covered with plastic tube, or a spring hosepipe. The drawbacks of the prior art connecting device are as follows:

1. The connecting device with an electrical cable cannot fix the electrical device in one position, and the electrical cable is easily dislocated and damaged during use.

2. The connecting device with a single wire covered with plastic tube has a short lifespan because the single wire is unable to support heavy weight and as such is easily broken.

3. The connecting device with a spring hosepipe is unable to support heavy weight so any electrical device must be small and light.

SUMMARY OF THE INVENTION

It is therefore a primary objective of the present invention to provide a supporting apparatus for supporting an electric device in a car to solve the mentioned problems.

Briefly, in a preferred embodiment, the present invention provides a supporting apparatus for supporting an electric device in a car comprising:

- a plug having a front end and a rear end over which the front end of the plug being can be plugged into and fixed in an electric socket of the car;
- a flexible steel tube having two ends fixed to the rear end of the plug and the electric device separately;
- a plurality of flexible steel wire ropes each having two ends fixed to the rear end of the plug and the electric device separately, the plurality of steel wire ropes being positioned separately at two sides of the steel tube for strengthening the steel tube; and
- an electric wire installed in the steel tube for electrically connecting the electric device to the plug;

wherein when an user bends or rotates the supporting apparatus, the steel tube and steel wire ropes of the supporting apparatus will be flexibly bent or rotated and the electric device will be approximately maintained at the bent or rotated position.

It is an advantage of the present invention that the supporting apparatus according to the present invention has a steel tube with a steel wire rope support so the electrical device can be approximately maintained at the bent or rotated position.

These and other objects and the advantages of the present invention will no doubt become obvious to those of ordinary skill in the art after having read the following detailed description of the preferred embodiment that is illustrated in the various figures and drawings.

DETAILED DESCRIPTION OF THE PREFERRED EMBODIMENT

Figure 1:
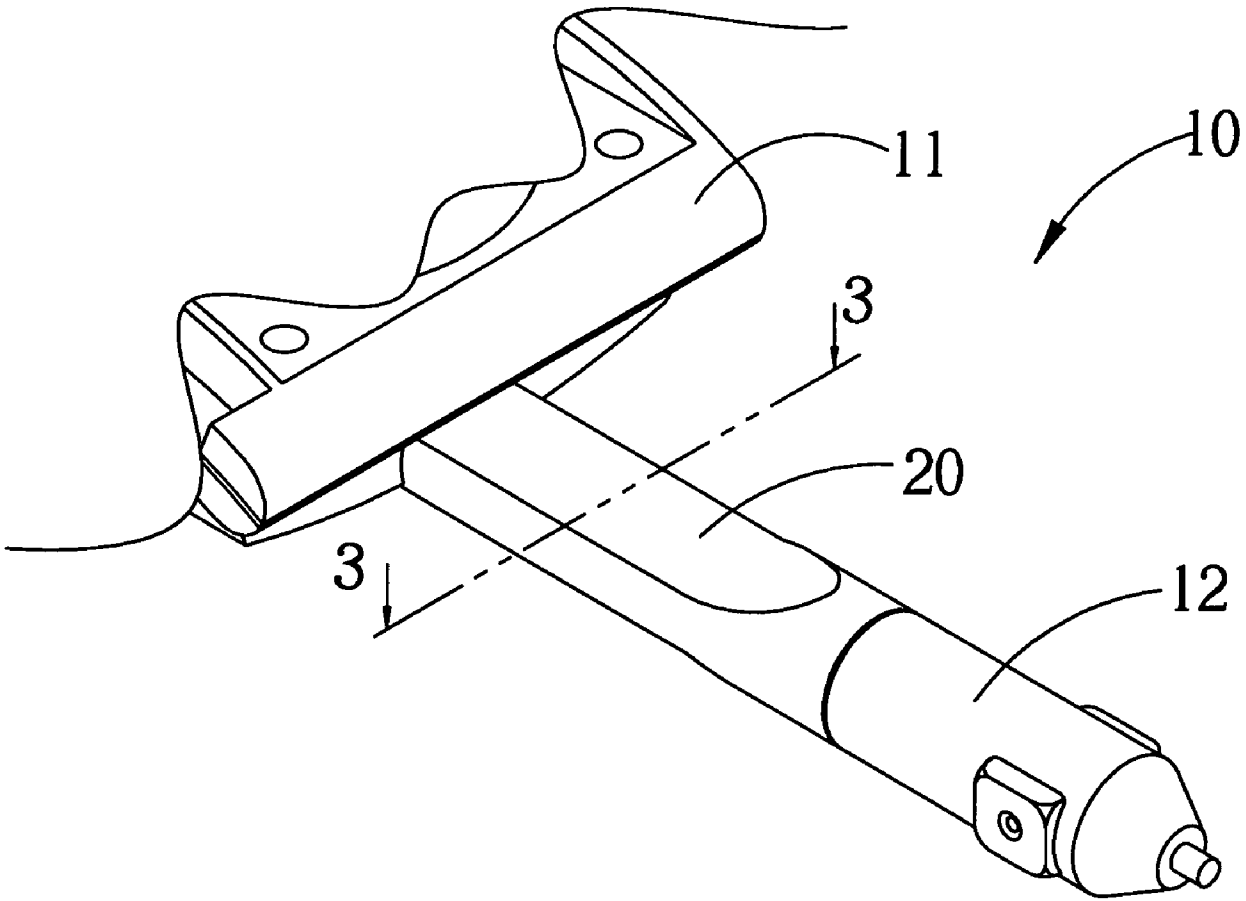
FIG. 1 is an outside view of a supporting apparatus according to the present invention.

Please refer to FIG. 1. FIG. 1 is an outside view of a supporting apparatus 10 according to the present invention. The supporting apparatus 10 supports an electric device 11 in a car and comprises a plug 12 the front end of which can be plugged into the electric cigarette lighter (not shown) of the car, and a plastic cover 20 made of flexible plastic material for protecting the internal components.

Figure 2:
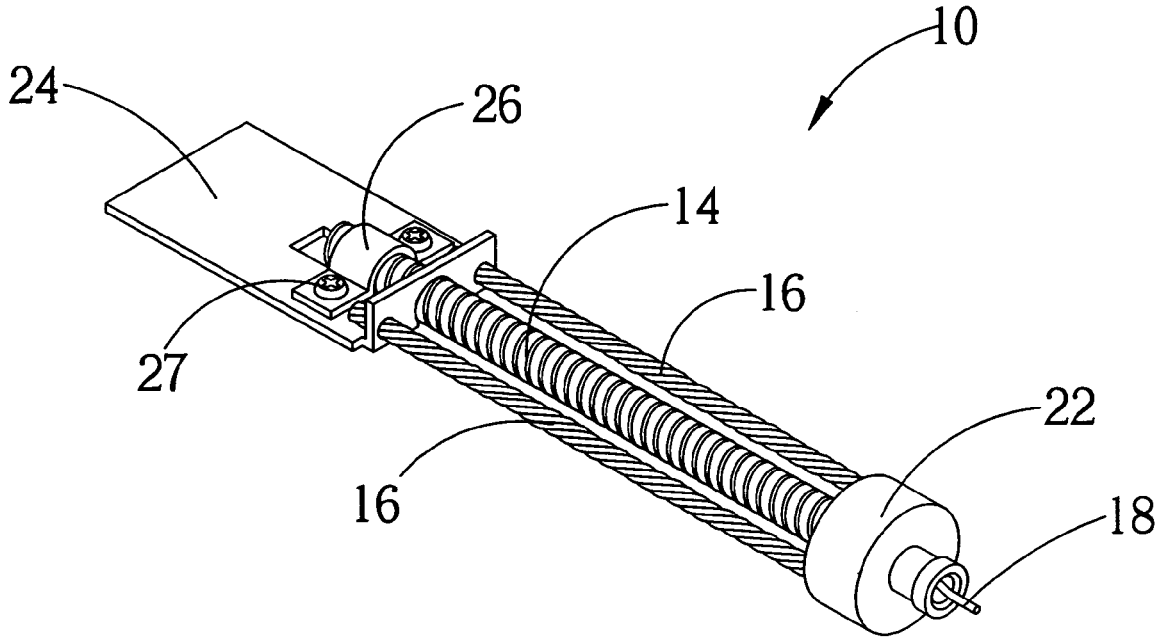
FIG. 2 is a perspective diagram of the supporting apparatus in FIG. 1.
Figure 3:
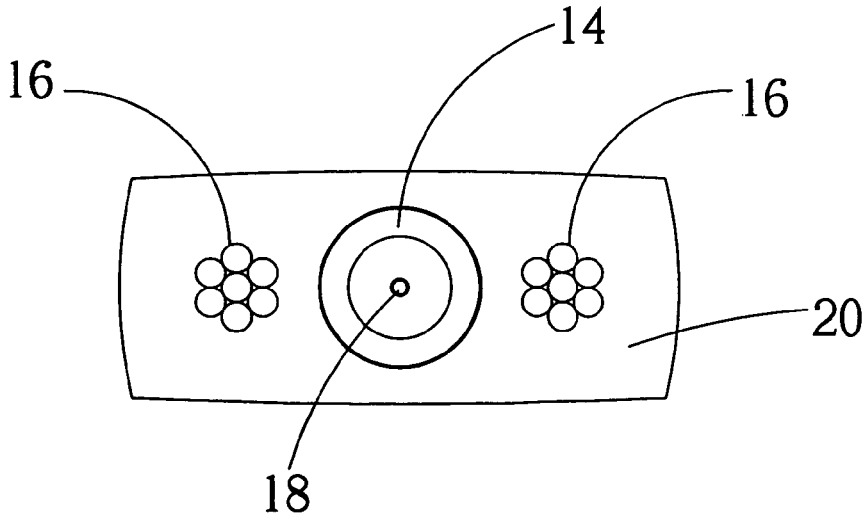
FIG. 3 is a sectional diagram of the supporting apparatus along a line 3—3.

Please refer to FIG. 2 and FIG. 3. FIG. 2 is a perspective diagram of the supporting apparatus 10 in FIG. 1. FIG. 3 is a sectional diagram of the supporting apparatus 10 along a line 3—3. The supporting apparatus 10 further comprises a flexible steel tube 14, two flexible steel wire ropes 16, and an electric wire 18. The flexible steel tube 14 has two ends one of which is fixed to the rear end of the plug 12 and the other of which is fixed to the electric device 11. Each of the flexible steel wire ropes 16 has two ends one of which is fixed to the rear end of the plug 12 and the other of which is fixed to the electric device 11. The two steel wire ropes 16 are symmetrically installed at two sides of the steel tube 14 and strengthen the steel tube 14. The electric wire 18 is installed in the steel tube 14 for electrically connecting the electric device 11 to the plug 12. When the supporting apparatus 10, the steel tube 14, steel wire ropes 16 and plastic cover 20 is flexibly bent or rotated, the electric device 11 will be approximately maintained at the bent or rotated position.

The supporting apparatus 10 further comprises a rigid plastic head piece 22, an L-shaped metal piece 24, and a metal piece 26. The rigid plastic head piece 22 is integrally built at the end of the steel tube 14 and steel wire ropes 16 near the plug 12 for fastening the steel tube 14 and steel wire ropes 16 together. The L-shaped metal piece 24 is embedded in a plastic housing of the electric device 11. The L-shaped metal piece 24 comprises a first plate and a second plate which are perpendicular to each other. The first plate comprises three holes for allowing one end of the steel tube 14 and steel wire ropes 16 to pass through and become embedded in the plastic housing of the electric device 11. The metal piece 26 is used for fixing the steel tube 14 and steel wire ropes 16 to the second plate of the L-shaped metal piece 24 and prevents loosening of the steel tube 14 and steel wire ropes 16.

Each of the steel wire ropes 16 is formed by a combination of seven stainless steel wires with a total diameter of about 0.8 mm. The two steel wire ropes 16 are symmetrically installed at two sides of the steel tube 14. The plastic cover 20 is made of flexible plastic material and is formed directly outside the steel tube 14 and steel wire ropes 16. The supporting apparatus 10 can be bent or rotated and then fixed at any position. It therefore has a long lifespan since the flexible steel tube 14 and two flexible steel wire ropes 16 can withstand being bent numerous times.

The supporting apparatus 10 can be a connecting device that connects a cellular phone to an electrical socket of the cigarette lighter at a particular angle within a predetermined range. The cellular phone can be adjusted so that it does not interfere with the gear shifting mechanism of the car. The angle between the microphone and speaker can also be adjusted.

The supporting apparatus 10 has a steel tube 14 and supporting steel wire ropes 16 such that the electrical device can be approximately maintained at the bent or rotated position. The supporting apparatus 10 connects the electrical device to the electric socket and has a long lifespan.

Those skilled in the art will readily observe that numerous modifications and alterations of the propeller may be made while retaining the teachings of the invention. Accordingly, the above disclosure should be construed as limited only by the metes and bounds of the appended claims.

What is claimed is:

1. A supporting apparatus for supporting an electric device in a car, the supporting apparatus comprising:

a plug having a front end and a rear end, the front end adapted for plugging into an electric socket of the car;

a flexible steel tube being connected between the rear end of the plug and the electric device;

a plurality of flexible steel wire ropes being connected between the rear end of the plug and the electric device, the plurality of steel wire ropes being positioned on different sides of the steel tube for strengthening the steel tube;

an L-shaped metal piece embedded in a plastic housing of the electric device wherein the L-shaped metal piece comprises a first plate and a second plate perpendicular to each other and the first plate comprises a plurality of holes for allowing one end of the steel tube and steel wire ropes to pass through and embed in the plastic housing of the electric device; and an electric wire installed in the steel tube for electrically connecting the electric device to the plug;

wherein the steel tube and steel wire ropes of the supporting apparatus are capable of being bent or rotated for adjusting the position of the electric device to the bent or rotated position.

2. The supporting apparatus of claim 1 further comprising a plastic cover covering the steel tube and steel wire ropes for protecting the steel tube and steel wire ropes.

3. The supporting apparatus of claim 2 wherein the plastic cover is made of flexible plastic material and is formed directly outside the steel tube and steel wire ropes.

4. The supporting apparatus of claim 1 comprising two steel wire ropes installed at two sides of the steel tube for strengthening the steel tube.

5. The supporting apparatus of claim 1 further comprising a rigid plastic head piece integrally built at one end of the steel tube and steel wire ropes near the plug for fastening the steel tube and steel wire ropes together.

6. The supporting apparatus of claim 1 further comprising a metal piece for fixing the steel tube and steel wire ropes to the second plate of the L-shaped metal piece.

7. The supporting apparatus of claim 1 wherein the electric socket of the car is an electric cigarette lighter socket.

8. The supporting apparatus of claim 1 wherein each of the steel wire ropes comprises a plurality of stainless steel wires joined together.

* * * * *

UNITED STATES PATENT AND TRADEMARK OFFICE

CERTIFICATE OF CORRECTION

PATENT NO. : 7,040,923 B1
APPLICATION NO. : 09/330034
DATED : May 9, 2006
INVENTOR(S) : Min-Chen et al.

It is certified that error appears in the above-identified patent and that said Letters Patent is hereby corrected as shown below:

Please insert item [30], Foreign Application Priority Data no. 88105634 dated 4/9/1999.

Signed and Sealed this

Seventeenth Day of October, 2006

JON W. DUDAS
*Director of the United States Patent and Trademark Office*